US007048075B2

(12) United States Patent
Saito et al.

(10) Patent No.: US 7,048,075 B2
(45) Date of Patent: May 23, 2006

(54) POWER TOOL

(75) Inventors: Takuma Saito, Ibaraki (JP); Shinki Ohtsu, Ibaraki (JP); Yasuki Ohmori, Ibaraki (JP); Chikai Yoshimizu, Ibaraki (JP); Katsuhiro Oomori, Ibaraki (JP); Masanori Watanabe, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/085,585

(22) Filed: Mar. 1, 2002

(65) Prior Publication Data

US 2002/0121384 A1 Sep. 5, 2002

(30) Foreign Application Priority Data

Mar. 2, 2001 (JP) ..... P2001-058625

(51) Int. Cl.
*B25B 19/00* (2006.01)

(52) U.S. Cl. ..... 173/93.5; 173/93; 173/178; 173/210; 173/216

(58) Field of Classification Search ..... 173/93, 173/93.6, DIG. 2, 162.2, 210, 178, 176, 216, 173/93.5; 464/74, 76, 51; 74/411, 443, 74/440

See application file for complete search history.

(56) References Cited

U.S. PATENT DOCUMENTS

| | | | | |
|---|---|---|---|---|
| 2,341,497 | A | 2/1944 | Amtsberg | |
| 3,174,606 | A * | 3/1965 | Hornschuch et al. | 192/150 |
| 3,392,793 | A | 7/1968 | Pauley | |
| 3,768,577 | A | 10/1973 | Leoni | |
| 3,837,179 | A * | 9/1974 | Barth | 464/76 |
| 4,585,078 | A * | 4/1986 | Alexandrov et al. | 173/93.5 |
| 4,779,470 | A * | 10/1988 | Morita et al. | 464/76 |
| 5,339,908 | A * | 8/1994 | Yokota et al. | 173/216 |
| 5,601,149 | A * | 2/1997 | Kawasaki et al. | 173/93.5 |
| 5,706,902 | A * | 1/1998 | Eisenhardt | 173/93.5 |
| 5,816,102 | A * | 10/1998 | Kern et al. | 464/76 |
| 5,873,786 | A * | 2/1999 | Hosoya et al. | 464/73 |
| 5,924,928 | A * | 7/1999 | Stegman et al. | 464/76 |
| 6,045,448 | A * | 4/2000 | Kern et al. | 464/74 |
| 6,098,726 | A * | 8/2000 | Taylor et al. | 175/320 |
| 6,131,477 | A * | 10/2000 | Gaydek et al. | 464/74 |
| 6,155,356 | A * | 12/2000 | Kikuchi et al. | 173/211 |
| 6,457,535 | B1 | 10/2002 | Tanaka | |
| 6,705,410 | B1 * | 3/2004 | Ziegler | 173/201 |

FOREIGN PATENT DOCUMENTS

| | | |
|---|---|---|
| DE | 11 88 517 | 1/1957 |
| DE | 19 56 210 C3 | 5/1971 |
| DE | 29 12 718 A1 | 3/1979 |
| DE | 195 05 068 C2 | 2/1995 |
| JP | 02-130711 | 10/1990 |
| JP | 07-31281 | 6/1995 |
| JP | 10-166279 | 6/1998 |

* cited by examiner

*Primary Examiner*—Scott A. Smith
(74) *Attorney, Agent, or Firm*—McGinn IP Law Group, PLLC

(57) ABSTRACT

A power tool includes a powered drive source, a speed reduction mechanism portion for transmitting a rotational power of the drive source, a striking mechanism portion for converting the rotational power of the speed reduction mechanism portion into a striking force, an end tool for outputting the striking force and a rotational force through the striking mechanism portion, and an impact damping mechanism for damping the impact of the end tool in a direction of rotation of the speed reduction mechanism.

29 Claims, 7 Drawing Sheets

RELATED ART

POWER TOOL

BACKGROUND OF THE INVENTION

1. Field of the Invention

This invention relates to a power tool such as an impact screwdriver and an oil pulse screwdriver.

2. Description of the Related Art

A conventional power tool will be described with reference to FIG. 8. FIG. 8 is a partly-omitted, vertical cross-sectional, side-elevational view showing an impact tool for imparting a rotational force and a striking force to an end tool 20 such as a bit. Generally, a motor 2, serving as a drive source, a speed reduction mechanism portion 8 for transmitting a rotational power of a pinion 4 which is an output shaft of the motor 2, a spindle 14 for transmitting the rotational power from the speed reduction mechanism portion, a hammer 15, which is rotatable and movable in a direction of the axis of rotation through steel balls 16 inserted in cam grooves 14*a* formed in the spindle 14, an anvil 17, having anvil claws 17*b* which are struck by a plurality of hammer claws 15*b*, provided at the hammer 15, to be rotated, the end tool 20, releasably attached to the anvil 17, and a spring 12, normally urging the hammer 15 toward the anvil 17, are received within a housing 1 and a casing 10 which form a impact tool body. The speed reduction mechanism portion includes a fixed gear support jig 7, which has rotation stoppers, and is supported within the housing 1, a fixed gear 6, planetary gears 8, and the spindle 14, and further includes needle pins 9 serving as rotation shafts for the planetary gears 8, and the gears 8 and the needle pins 9 form part of the spindle 14. One end the spindle 14 is borne by a bearing 11, and the other end thereof is rotatably supported in a central hole 17*a* in the anvil 17 rotatably supported by a metal bearing 18.

A trigger switch 3 is operated to supply electric power to the motor 2 to drive this motor 2 for rotation, and then the rotational power of this motor 2 is transmitted to the planetary gears 8 through the pinion 4 connected to the distal end of the motor 2, and the rotational power of the pinion 4 is transmitted to the spindle 14 through the needle pins 9 by the meshing engagement of the planetary gears 8 with the fixed gear 6, and the rotational force of the spindle 14 is transmitted to the hammer 15 through the steel balls 16 each disposed between the cam groove 14*a* of the spindle 14 and a cam groove 15*a* of the hammer 15, and the hammer claw 15*b* of the hammer 15, urged forward (toward the bit) by the spring 12 provided between the hammer 5 and the planetary gears 8 of the spindle 14, strikes the anvil claw 17*b* of the anvil 17 as a result of the rotation, thereby producing a pulse-like impact which is imparted to a screw, a nut or the like to be tightened by the end tool 20. After the striking operation, the striking energy of the hammer 15 decreases, and the torque of the anvil 17 decreases, whereupon the hammer 15 rebounds from the anvil 17, and therefore the hammer 15 moves toward the planetary gears 8 along the cam grooves 15*a* and 14*a*. Before the hammer 15 impinges on a stopper 22, the hammer 15 is again moved back along the cam grooves 15*a* and 14*a* toward the anvil 17 by the compressive force of the spring 12, and the hammer 15 is accelerated by the rotation of the spindle 14 through the steel balls 16 each disposed between the cam groove 14*a* of the spindle 14 and the cam groove 15*a* of the hammer 15. During the reciprocal movement of the hammer 15 toward the stopper 22 along the cam grooves 14*a* and 15*a*, the spindle 14 continues to rotate, and therefore in the case where the hammer claw 15*b* of the hammer 15 moves past the anvil claw 17*b* of the anvil 17, and again strikes the anvil claw 17*b*, the hammer 15, when rotated through 180°, strikes the anvil 17. Thus, the anvil 17 is repeatedly struck by the axial movement and rotation of the hammer 15, and by doing so, the screw or the like is tightened while continuously imparting the impact torque thereto.

As described above, by the rotation and axial movement of the hammer, the hammer claw of the hammer was caused to repeatedly impinge on the anvil claw of the anvil, thereby imparting the impact torque to the anvil. However, in the case of driving the screw into a hard wooden material or in the case of fastening a bolt to an iron plate, the rebounding force, produced by the anvil upon impingement, was very large, so that the hammer was moved back until it impinged on the stopper provided at the spindle. Therefore, each time the hammer impinged on the stopper, there was exerted a force to instantaneously lock (press) the rotating spindle. Therefore, even when the locking effect acted on the spindle, a large load (rotational impact force) was exerted on the gear portions of the speed reduction mechanism portion, provided between the motor and the spindle, since the pinion of the motor was rotating, and as a result there was encountered a problem that the speed reduction mechanism portion and the housing, holding this speed reduction mechanism portion, were damaged. And besides, a locking effect acted on the spindle when the hammer claw impinged on the anvil claw, and therefore there was encountered a problem that the speed reduction mechanism portion and the housing, holding this speed reduction mechanism portion, were damaged.

SUMMARY OF THE INVENTION

This invention seeks to provide a power tool of a long lifetime which is enhanced in durability by overcoming the above problems and by damping a rotational impact force acting on a speed reduction mechanism portion.

The above object has been achieved by a power tool comprising a motor serving as a drive source, a speed reduction mechanism portion for transmitting a rotational power of the motor, a striking mechanism portion for converting the rotational power of the speed reduction mechanism portion into a striking force, and an end tool for outputting the striking force and a rotational force through the striking mechanism portion; characterized in that there is provided an impact damping mechanism for damping an impact in a direction of rotation of the speed reduction mechanism portion.

DETAILED DESCRIPTION OF THE PREFERRED EMBODIMENTS

Figure 1:
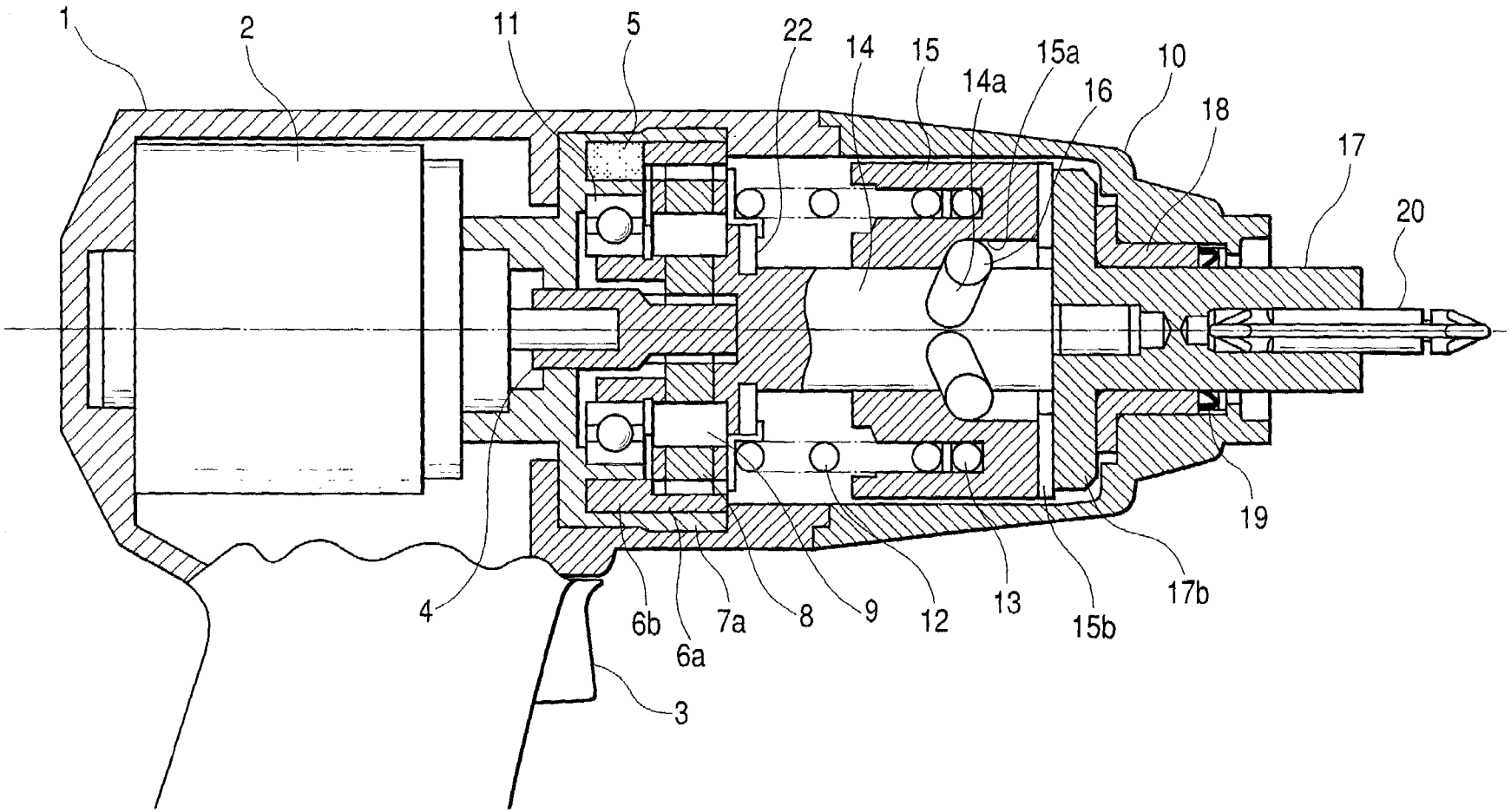
FIG. 1 is a partly-omitted, vertical cross-sectional, side-elevational view showing an impact tool of the present invention.
Figure 2:
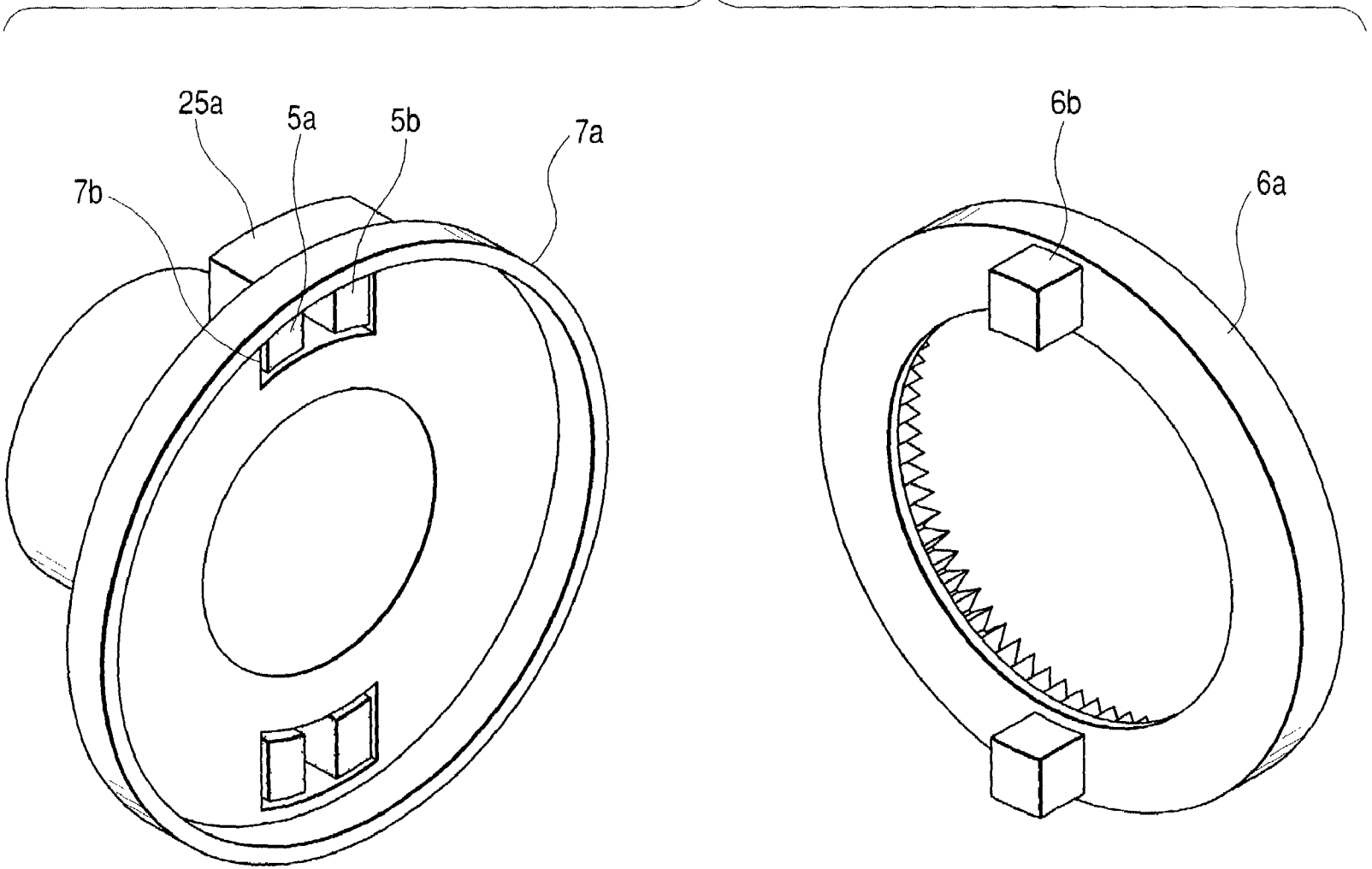
FIG. 2 is an exploded view showing a first embodiment of an impact damping mechanism mounted on the impact tool of FIG. 1.

An impact tool of this embodiment will now be described with reference to FIGS. 1 to 6. FIGS. 1 and 2 show a first embodiment, and FIG. 1 is a partly-omitted, vertical cross-sectional, side-elevational view showing the impact tool, and FIG. 2 is an exploded view showing an impact damping mechanism mounted on the impact tool. In FIGS. 1 and 2, a motor 2, serving as a drive source, a speed reduction mechanism portion 8 for transmitting a rotational power of a pinion 4 which is an output shaft of the motor 2, a spindle 14 for transmitting the rotational power from the speed reduction mechanism portion 8, a hammer 15, which is rotatable and movable in a direction of the axis of rotation through steel balls 16 inserted in cam grooves 14*a* formed in the spindle 14, an anvil 17, having anvil claws 17*b* which are struck by a plurality of hammer claws 15*b*, provided at the hammer 15, to be rotated, an end tool 20, releasably attached to the anvil 17, and a spring 12, normally urging the hammer 15 toward the anvil 17, are received within a housing 1 and a casing 10 which form a impact tool body of the impact tool. A striking mechanism portion mainly comprises the spring 12, the spindle 14, the hammer 15, the steel balls 16 and the anvil 17. The speed reduction mechanism portion includes a fixed gear support jig 7, which has rotation stoppers, and is supported against rotation within the housing 1, a fixed gear 6, planetary gears 8, and the spindle 14, and further includes needle pins 9 serving as rotation shafts for the planetary gears 8, and the gears 8 and the needle pins 9 form part of the spindle 14. One end the spindle 14 is borne by a bearing 11, and the other end thereof is rotatably supported in a central hole 17*a* in the anvil 17 rotatably supported by a metal bearing 18.

A trigger switch 3 is operated to supply electric power to the motor 2 to drive this motor 2 for rotation, and then the rotational power of this motor 2 is transmitted to the planetary gears 8 through the pinion 4 connected to the distal end of the motor 2, and the rotational power of the pinion 4 is transmitted to the spindle 14 through the needle pins 9 by the meshing engagement of the planetary gears 8 with the fixed gear 6, and the rotational force of the spindle 14 is transmitted to the hammer 15 through the steel balls 16 each disposed between the cam groove 14*a* of the spindle 14 and a cam groove 15*a* of the hammer 15, and the hammer claw 15*b* of the hammer 15, urged forward (toward the bit) by the spring 12 provided between the hammer 15 and the planetary gears 8 of the spindle 14, strikes the anvil claw 17*b* of the anvil 17 as a result of the rotation, thereby producing a pulse-like impact which is imparted to a screw, a nut or the like to be tightened by the end tool 20. After the striking operation, the striking energy of the hammer 15 decreases, and the torque of the anvil 17 decreases, whereupon the hammer 15 rebounds from the anvil 17, and therefore the hammer 15 moves toward the planetary gears 8 along the cam grooves 15*a* and 14*a*. Before the hammer 15 impinges on a stopper 22, the hammer 15 is again moved back along the cam grooves 15*a* and 14*a* toward the anvil 17 by the compressive force of the spring 12, and the hammer 15 is accelerated by the rotation of the spindle 14 through the steel balls 16 each disposed between the cam groove 14*a* of the spindle 14 and the cam groove 15*a* of the hammer 15. During the reciprocal movement of the hammer 15 toward the stopper 22 along the cam grooves 14*a* and 15*a*, the spindle 14 continues to rotate, and therefore in the case where the hammer claw 15*b* of the hammer 15 moves past the anvil claw 17*b* of the anvil 17, and again strikes the anvil claw 17*b*, the hammer 15, when rotated through 180°, strikes the anvil 17. Thus, the anvil 17 is repeatedly struck by the axial movement and rotation of the hammer 15, and by doing so, the screw or the like is tightened while continuously imparting the impact torque thereto.

The impact damping mechanism is mounted on the thus operating impact tool, and as shown in FIG. 2, this impact damping mechanism comprises the fixed gear support jig 7*a* which has the rotation stoppers 25*a* the direction of rotation of which is fixed within the housing 1, and has a circular outer peripheral portion, and has its center held in a predetermined position relative to the housing 1, the fixed gear 6*a*, which is held within an inner periphery of the fixed gear support jig 7*a* so as to rotate very slightly, with its center held in a predetermined position, and impact damping members 5*a* and 5*b* which are inserted in holes 7*b*, formed in the fixed gear support jig 7*a*, and engage projections 6*b* formed on a side surface of the fixed gear 6*a*.

With this impact damping mechanism, when the hammer 15 moves toward the planetary gears 8 along the cam grooves 15*a* and 14*a*, and impinges on the stopper 22, the pinion 4 is always rotating, but the claws 6*b* of the fixed gear 6 compress the impact damping members 5*a* and 5*b*, and therefore the impact force in the rotational direction can be damped by the very slight rotation of the fixed gear 6*a*. In this construction, the impact damping members 5*a* and 5*b* are provided in a gap between the bearing 11, which is the rear bearing for the spindle 14, and the housing 1, and therefore the damping mechanism can be provided effectively without increasing the overall length of the tool. And besides, the impact damping members 5*a* and 5*b* are arranged in the direction of the rotational load, and are provided on opposite sides of the projection 6*b*, respectively, and therefore can meet the normal and reverse rotation of the motor 2 and the vibration of the load. The number of the projections 6*b* is not limited to two as in the illustrated example, but at least one projection need only to be provided.

Figure 3:
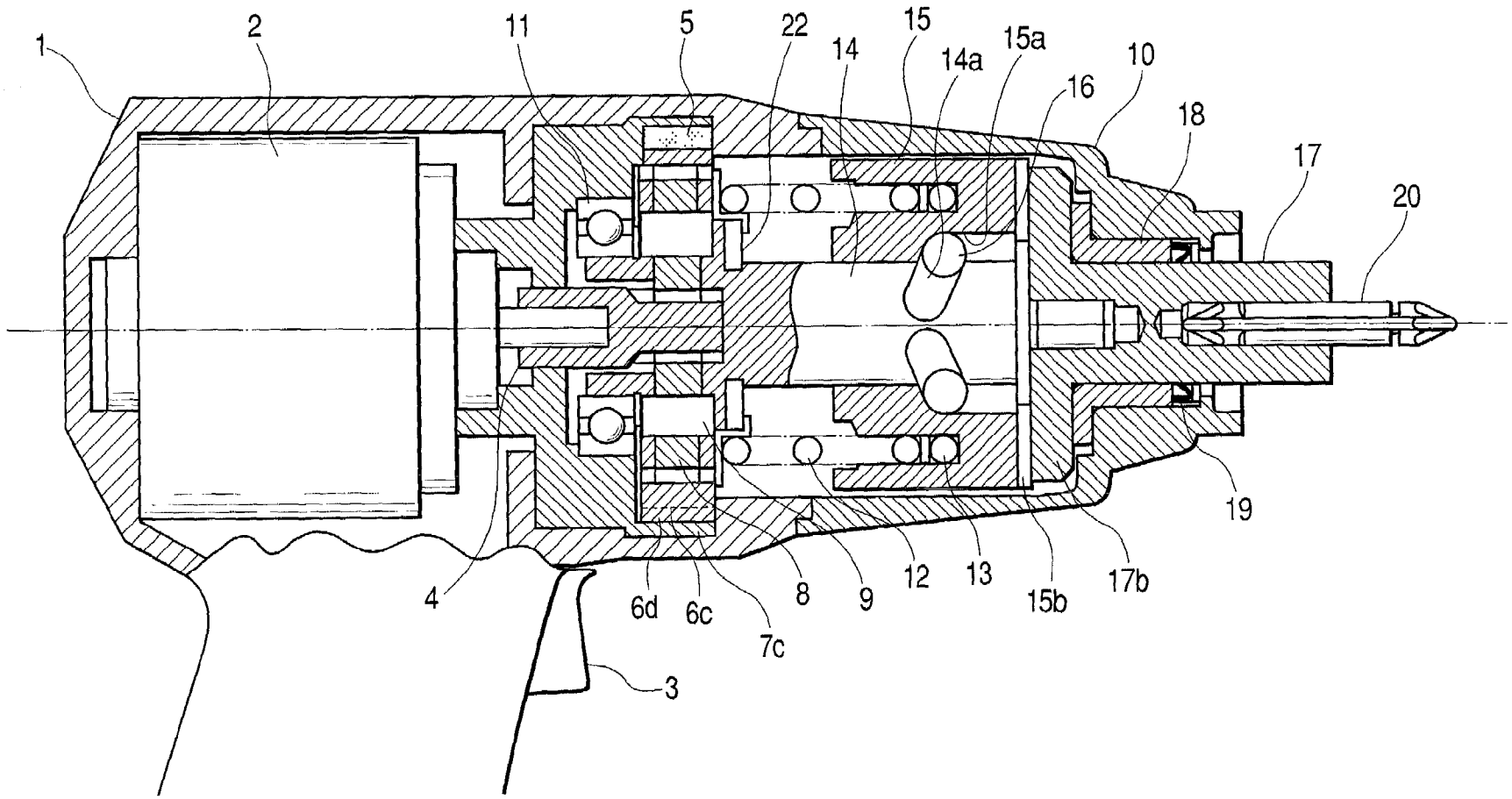
FIG. 3 is a partly-omitted, vertical cross-sectional, side-elevational view showing an impact tool of the present invention.
Figure 4:
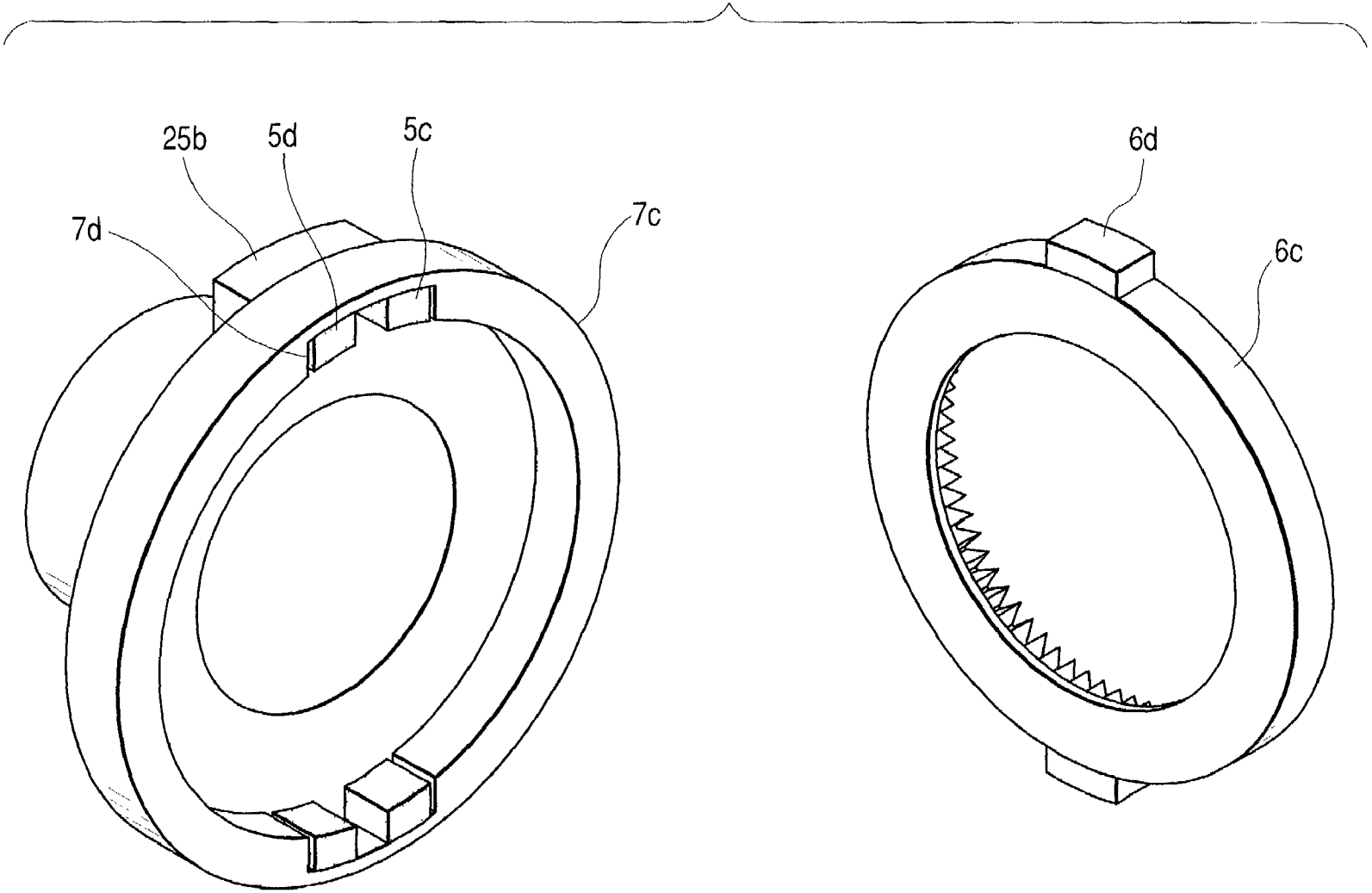
FIG. 4 is an exploded view showing a second embodiment of an impact damping mechanism mounted on the impact tool of FIG. 3.

FIGS. 3 and 4 show a second embodiment, and FIG. 3 is a partly-omitted, vertical cross-sectional, side-elevational view showing an impact tool, and FIG. 4 is an exploded view showing an impact damping mechanism mounted on the impact tool. The impact damping mechanism is mounted on the impact tool shown in FIG. 3, and in this impact damping mechanism, projections 6*d* are formed on an outer surface of a fixed gear 6*c* as shown in FIG. 4, and holes 7*d* are formed respectively in those portions of a fixed gear support jig 7*c* (which is mounted within a housing 1) corresponding respectively to the projections 6*d* on the outer surface of the fixed gear 6*c*, and impact damping members 5*c* and 5*d* are inserted in these holes 7*d*.

In this impact damping mechanism, the fixed gear 6*c* is combined with the fixed gear support jig 7*c* in such a manner that the projection 6*d* of the fixed gear 6*c* is inserted between the impact damping members 5*c* and 5*d*. Therefore, the load is supported at a more radially-outward side of the fixed gear 6*c* as compared with the impact damping mechanism shown in FIGS. 1 and 2, and therefore the load can be damped more effectively. Although the outer diameter of the fixed gear support jig 7*c* and the size of the housing 1 are slightly increased, the sufficient effect can be obtained.

Figure 5:
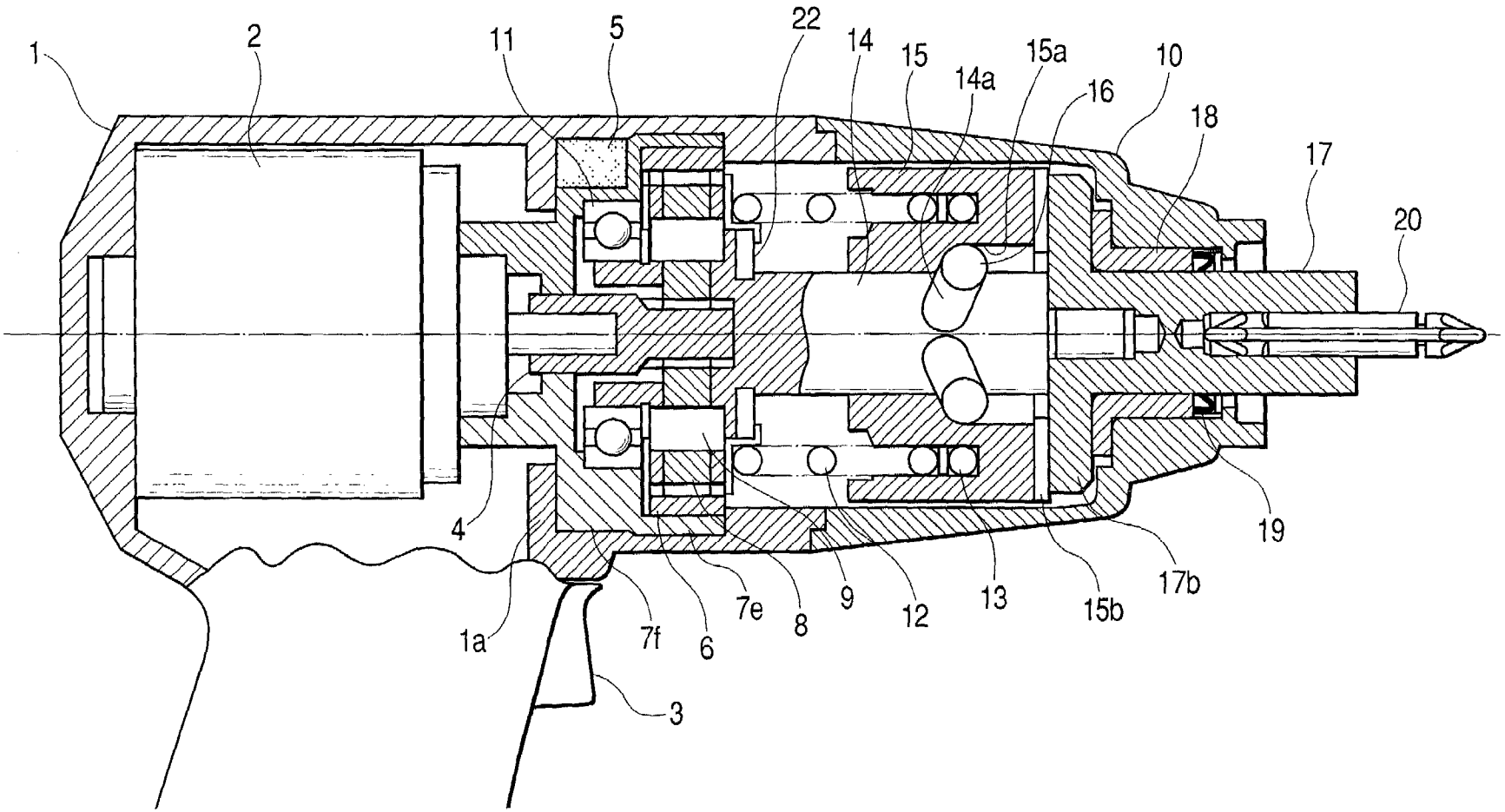
FIG. 5 is a partly-omitted, vertical cross-sectional, side-elevational view showing an impact tool of the present invention.
Figure 6:
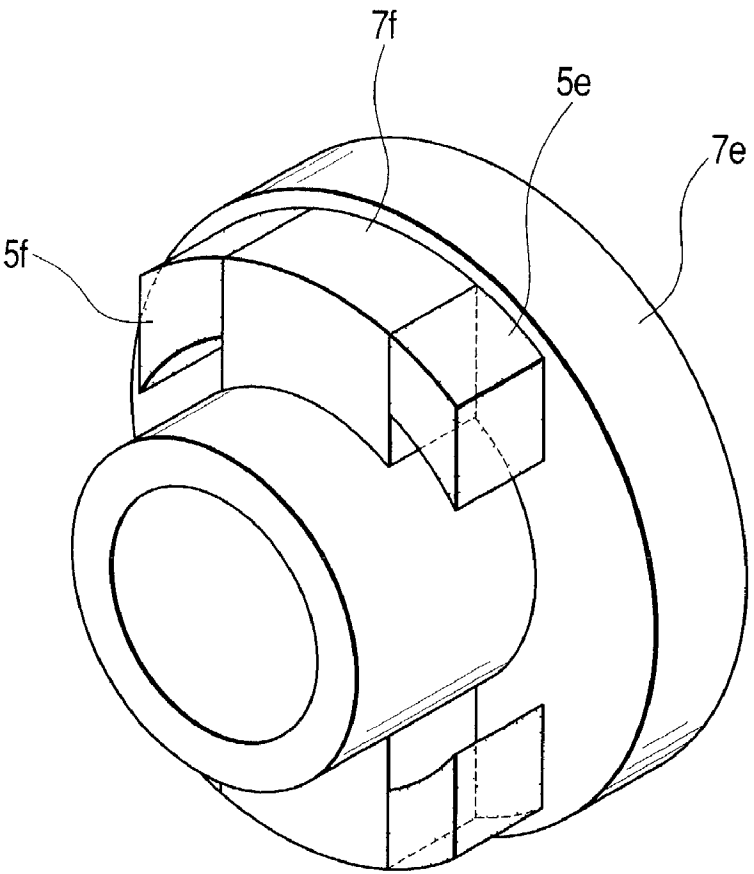
FIG. 6 is an exploded view showing a third embodiment of an impact damping mechanism mounted on the impact tool of FIG. 5.
Figure 8:
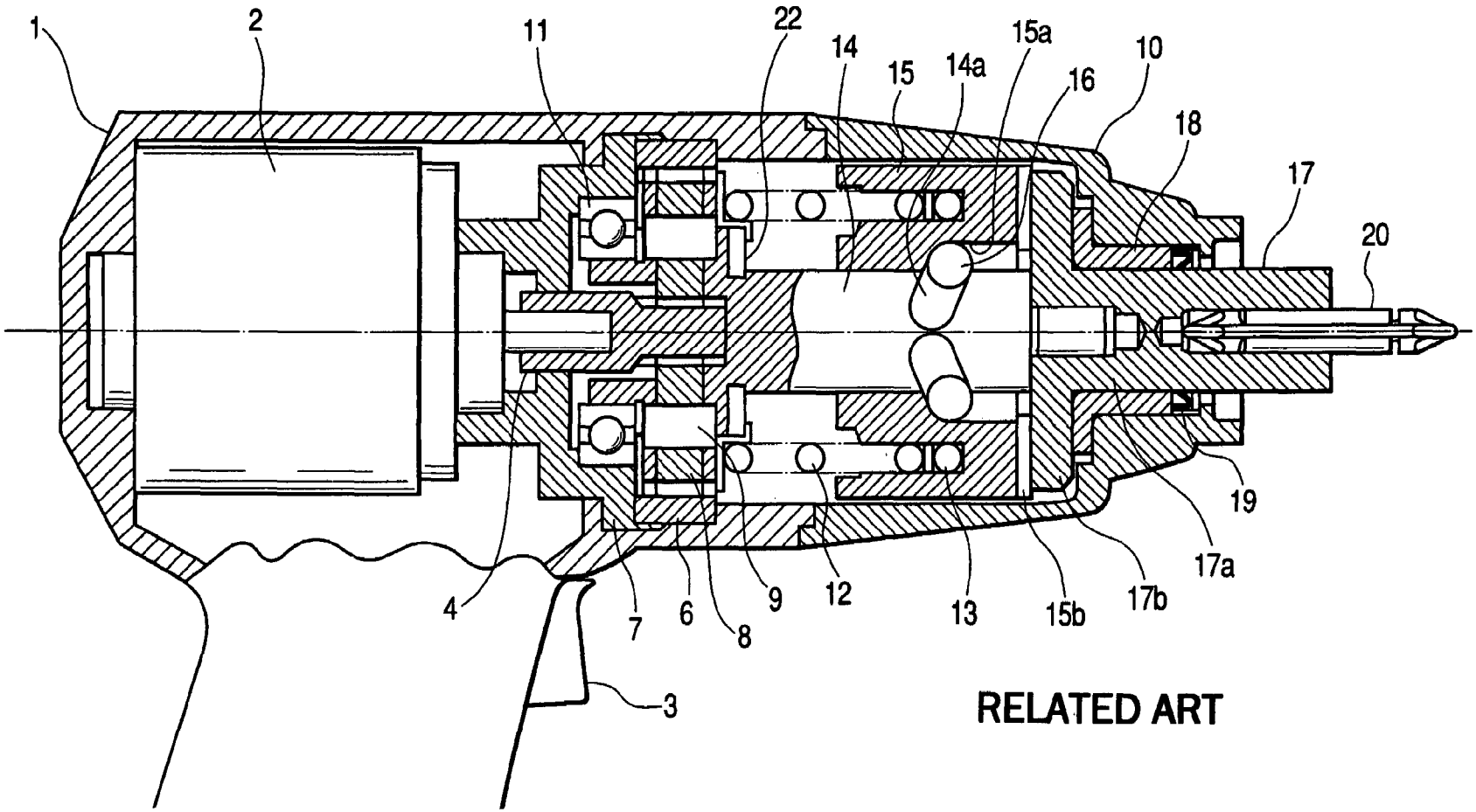
FIG. 8 is a partly-omitted, vertical cross-sectional, side-elevational view showing a conventional impact tool.

FIGS. 5 and 6 show a third embodiment, and FIG. 5 is a partly-omitted, vertical cross-sectional, side-elevational view showing an impact tool, and FIG. 6 is an exploded view showing an impact damping mechanism mounted on the impact tool. The impact damping mechanism is mounted on the impact tool shown in FIG. 5, and in this impact damping mechanism, a fixed gear 6 and a fixed gear support jig 7*e* are fixedly secured to each other as shown in FIG. 6, and impact damping members 5*e* and 5*f* are provided respectively on opposite sides of each of projections 7*f* which are rotation stoppers for preventing the rotation of the fixed gear support jig 7*e* relative to a housing 1.

In this impact damping mechanism, that side of each impact damping member 5*e*, 5*f*, facing in the same direction as the projection 7*f*, is held by a rib 1*a* of the housing 1 of the body, and besides the impact damping members 5*e* and 5*f* are provided between a bearing 11 and the housing 1, and therefore a rotational impact force can be damped without increasing the overall length.

Figure 7:
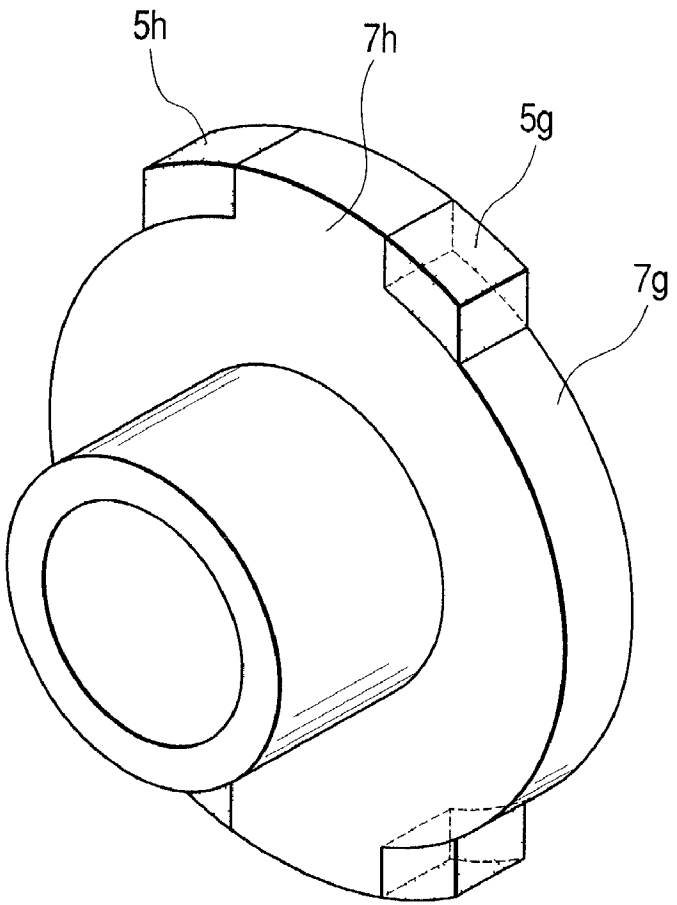
FIG. 7 is a perspective appearance view showing a fourth embodiment of an impact damping mechanism mounted on an impact tool of the invention.

FIG. 7 shows a fourth embodiment, and is a perspective appearance view showing an impact damping mechanism mounted on an impact tool. In the thus mounted impact damping mechanism, as shown in FIG. 7, a fixed gear 6 and a fixed gear support jig 7*g* are fixedly secured to each other, and projections 7*h* are formed on an outer surface of the fixed gear support jig 7*g*, and each of impact damping members 5*g* and 5*h* is arranged between that side of the projection 7*h*, facing in the direction of rotation, and a rib (not shown) of a housing 1.

In this impact damping mechanism, the load is supported at a more radially-outward side as compared with the impact damping mechanism shown in FIG. 6, and therefore the load can be damped more effectively as compared with the mechanism of FIG. 6. Although the outer diameter of the fixed gear support jig 7*g* and the size of the housing 1 are slightly increased, the sufficient effect can be obtained.

By combining the above-mentioned impact damping mechanisms, the rotational impact between the fixed gear 6 and the housing 1 can be further reduced, and preferably any one of various vibration-insulating rubber, soft plastics materials, felts and so on, which have a damping effect, is used as the impact damping material 5.

In the present invention, the rotational impact force of the speed reduction mechanism portion, produced by the abrupt acceleration of the impact mechanism portion, is damped, and by doing so, the jig, supporting the speed reduction mechanism portion, or the housing is enhanced in durability, so that the lifetime of the tool can be increased. And besides, the load, acting on the various portions, is reduced, and therefore materials, of which the various portions are made, can be changed to inexpensive, low-grade materials. By inserting the impact damping members between the bearing of the impact mechanism portion or the bearing of the speed reduction mechanism portion and the housing, a more compact-size design can be achieved.

By damping the abrupt rotational impact force, the vibration of the housing or the vibration of the motor, connected to the speed reduction mechanism portion, is reduced, and the operator, holding the impact tool, is less fatigued even when he uses the tool for a long period of time, and therefore the efficiency of the operation can be enhanced, and noises, produced by the vibration, can be reduced.

What is claimed is:

1. A power tool for imparting a rotational impact force to an end tool, comprising:

a housing;

a powered drive source;

a speed reduction mechanism portion comprising a gear that is substantially rotatably fixed with respect to the housing and transmitting a rotational power of said powered drive source;

a striking mechanism portion for converting the rotational power of said speed reduction mechanism portion into a striking force; and an impact damping mechanism for damping an impact on said speed reduction mechanism portion in a direction of rotation of said gear relative to said housing, wherein said speed reduction mechanism comprises a fixed gear support jig, and wherein said impact damping mechanism comprises an impact damping member formed in a hole in said fixed gear support jig.

2. A power tool according to claim 1, wherein said impact damping mechanism comprises:

a projection, formed on said gear of said speed reduction mechanism portion, and wherein said impact damping member is adjacent to said projection.

3. A power tool according to claim 2, wherein said projection on said gear is formed on a side surface or an outer surface of said gear.

4. A power tool according to claim 2, wherein said impact damping member is between said gear and said fixed gear support jig.

5. A power tool according to claim 1, wherein the drive source comprises a motor.

6. The power tool of claim 1, wherein said hole comprises a pair of holes which are oppositely disposed on said fixed gear support jig.

7. The power tool of claim 6, wherein said impact damping member comprises a plurality of impact damping members such that a pair of said plurality of impact damping members are formed in each of said pair of holes.

8. The power tool of claim 7, wherein said impact damping member further comprises a pair of projections formed on said gear of said speed reduction mechanism, each of said projections being disposed between a pair of said impact damping members.

9. A tool for imparting a rotational impact force to an end tool, comprising:

a housing;

a drive source;

a speed reduction mechanism comprising a gear that is substantially rotationally fixed relative to the housing and transmitting a power of said drive source;

a striking mechanism for converting the power of said transmitting mechanism into a striking force; and an impact damping mechanism for damping an impact of said speed reduction mechanism in a direction of rotation of said gear relative to the housing, wherein said speed reduction mechanism comprises a fixed gear support jig, and wherein said impact damping mechanism comprises an impact damping member formed in a hole in said fixed gear support jig.

10. The tool of claim 9, wherein said striking mechanism converts the rotational power of said speed reduction mechanism into said striking force.

11. The tool of claim 9, further comprising:

an end tool for outputting the striking force and a rotation force of said speed reduction mechanism through said striking mechanism.

12. The tool of claim 9, wherein said impact damping mechanism further comprises:

a projection formed on said gear of said speed reduction mechanism, and wherein said impact damping member is adjacent to said projection and said fixed gear support jig.

13. The power tool of claim 9, wherein said hole comprises a pair of holes which are oppositely disposed on said fixed gear support jig.

14. The power tool of claim 13, wherein said impact damping member comprises a plurality of impact damping members such that a pair of said plurality of impact damping members are formed in each of said pair of holes.

15. The power tool of claim 14, wherein said impact damping member further comprises a pair of projections formed on said gear of said speed reduction mechanism, each of said projections being disposed between a pair of said impact damping members.

16. An impact tool, powered by a driving force, for imparting a rotational impact force to an end tool, said impact tool comprising:

a housing;

a speed reduction mechanism comprising:

a gear that is substantially rotationally fixed relative to the housing; and an impact damping mechanism for damping said rotational impact force on a speed reduction mechanism in a direction of rotation of said gear relative to the housing; and a striking mechanism for converting the power of said speed reduction mechanism into said rotational impact force, wherein said speed reduction mechanism further comprises a fixed gear support jig, and wherein said impact damping mechanism comprises an impact damping member formed in a hole in said fixed gear support jig.

17. The apparatus of claim 16, wherein said impact damping mechanism further comprises:

a projection, formed on said gear of said speed reduction mechanism, and wherein said impact damping member is adjacent to said projection and said fixed gear support jig mounted in a housing of said impact tool.

18. The power tool of claim 16, wherein said hole comprises a pair of holes which are oppositely disposed on said fixed gear support jig.

19. The power tool of claim 18, wherein said impact damping member comprises a plurality of impact damping members such that a pair of said plurality of impact damping members are formed in each of said pair of holes.

20. The power tool of claim 19, wherein said impact damping member further comprises a pair of projections formed on said gear of said speed reduction mechanism, each of said projections being disposed between a pair of said impact damping members.

21. A tool for imparting a rotational impact force to an end tool, comprising:

a drive source;

a housing;

a speed reducer that comprises:

a fixed gear support jig that is fixedly supported by said housing of said tool; and a gear that is substantially rotationally fixed relative to said housing by said fixed gear support jig and that transmits a rotational movement from said drive source;

a striking mechanism that converts said rotational movement into a striking force; and an impact damping mechanism that dampens a rotational impact between said gear and said housing, wherein said impact damping mechanism comprises an impact damping member formed in a hole in said fixed gear support jig.

22. The power tool of claim 21, wherein said hole comprises a pair of holes which are oppositely disposed on said fixed gear support jig.

23. The power tool of claim 22, wherein said impact damping member comprises a plurality of impact damping members such that a pair of said plurality of impact damping members are formed in each of said pair of holes.

24. The power tool of claim 23, wherein said impact damping member further comprises a pair of projections formed on said gear of said speed reduction mechanism, each of said projections being disposed between a pair of said impact damping members.

25. A power tool for imparting a rotational impact force to an end tool, comprising:

a main body portion comprising:

a housing;

a motor serving as a drive source, a speed reduction mechanism portion for transmitting a rotational power of said motor, and a mechanical portion for transmitting the rotational power of the speed reduction mechanism portion to the end tool; and a handle portion connected to the main body portion, wherein said speed reduction mechanism portion comprises:

a first gear that is substantially rotationally fixed relative to the housing and comprising a second gear in an inner periphery of the first gear, and a fixed gear support member that holds the first gear, wherein a projection extends toward the motor from a side of the first gear, and wherein a hole portion that engages the projection is defined in the support member.

26. The power tool of claim 25, wherein the first gear is held, so as to rotate, by the fixed gear support member.

27. The power tool of claim 25, further comprising:

an impact damping mechanism disposed in the hole portion of the support member in a rotating direction of the first gear.

28. The power tool of claim 25, wherein an outer periphery of the support member is in contact with an inner peripheral surface of a housing of the main body portion, and wherein a rotation stoppage projection extends from a side of the housing toward the motor.

29. The power tool of claim 25, wherein an impact damping member is disposed on each side of the projection.

* * * * *